US005361303A

United States Patent [19]

Eatwell

[11] Patent Number: 5,361,303

[45] Date of Patent: Nov. 1, 1994

[54] FREQUENCY DOMAIN ADAPTIVE CONTROL SYSTEM

[75] Inventor: Graham P. Eatwell, Cambridge, United Kingdom

[73] Assignee: Noise Cancellation Technologies, Inc., Linthicum, Md.

[21] Appl. No.: 41,384

[22] Filed: Apr. 1, 1993

[51] Int. Cl.[5] ..... G10K 11/16

[52] U.S. Cl. ..... 381/71

[58] Field of Search ..... 381/71, 94

[56] References Cited

U.S. PATENT DOCUMENTS

| | | | |
|---|---|---|---|
| 3,617,717 | 11/1971 | Smith . | |
| 4,122,303 | 10/1978 | Chaplin . | |
| 4,153,815 | 5/1979 | Chaplin . | |
| 4,423,289 | 12/1983 | Swinbanks . | |
| 4,490,841 | 12/1984 | Chaplin . | |
| 4,654,871 | 3/1987 | Chaplin et al. | 381/72 |
| 4,878,188 | 10/1989 | Ziegler . | |
| 4,912,624 | 3/1990 | Harth et al. . | |
| 5,091,953 | 2/1992 | Tretter . | |

FOREIGN PATENT DOCUMENTS

| | | |
|---|---|---|
| WO88/02912 | 4/1988 | WIPO . |
| WO91/10226 | 4/1988 | WIPO . |
| PCT/US92/-05228 | 7/1991 | WIPO . |

OTHER PUBLICATIONS

Narendra and Anaswamy, *Stable Adaptive Systems,* Prentice Hall, Section 1.4.1 (1989).

Olsen, H. F. and May, E. G. Journal of the Acoustical Society of America. 25, 1130–1136. (1953).

Widrow, B. and Stearns S. D., *Adaptive Signal Processing,* Prentice Hall. 1985, (table of contents).

Narendra and Anaswamy. *Stable Adaptive Systems.* Prentice Hall: 1989.

Nelson and Elliot. *Active Control of Sound.* Academic Press. 1992. (table of contents).

*Primary Examiner*—Forester W. Isen

*Attorney, Agent, or Firm*—James W. Hiney

[57] ABSTRACT

A multiple-input, multiple-output adaptive control system which utilizes perturbations to the frequency components of the outputs to determine the desired changes to said coefficients. The control system is particularly suited to the active control of noise and vibration.

24 Claims, 9 Drawing Sheets

FREQUENCY DOMAIN ADAPTIVE CONTROL SYSTEM

INTRODUCTION

This invention relates to the active control of noise, vibration or other disturbances. Active control makes use of the principle of destructive interference by using a control system to generate disturbances (sound, vibration, electrical signals, etc.) which have an opposite phase to an unwanted disturbance. Active sound control is well known, see for example H. F. Olsen and E. G. May (1953), '*Electronic Sound Absorber*', *Journal of the Acoustical Society of America*, 25, 1130–136, and a recent survey of the known art is contained in the book '*Active Control of Sound*', *Academic Press*, 1992 by P. A. Nelson and S. J. Elliott.

Fields related to active noise and vibration control include process control and adaptive optics. One control technique which has successfully been applied in these areas is the method of parameter perturbations. This method is described in section 1.4.1 of Narendra and Anaswamy, '*Stable Adaptive Systems*', *Prentice Hall*, 1989. U.S. Pat. No. 3,617,717 (Smith et. al.) describes a technique using orthogonal modulation signals for the perturbations, while U.S. Pat. No. 4,912,624 (Harth et. al.) describes an analog technique which uses random perturbations.

Known systems for active control generate the control signals either by filtering a reference signal, as for example in U.S. Pat. No. 4,122,303 (Chaplin et. al.) or by waveform synthesis as in U.S. Pat. No. 4,153,815 (Chaplin et. al.). The systems are made adaptive by adjusting the filter coefficients or the coefficients of the waveform. The main advantage of this approach is that the coefficients need to be varied on a much slower time scale than that of the output control signals themselves.

In contrast, the parameter perturbation method seeks to adjust the control signal itself.

In adaptive control systems it is usual to monitor or measure the effect of the control and compare this to the desired effect so as to obtain a measure of the degree of misadjustment or error. Often the objective to reduce the level of a disturbance and sensors are used to measure the residual disturbance in order to provide the error signals. These sensors are often physically displaced from the control actuators and, since acoustic disturbances in solids or fluids have a finite propagation speed, this means that there is always some delay before the effect of a change to the output coefficients is recorded by the sensors.

In control theory the physical system is usually referred to as the plant. The existence of delay in the plant makes the known parameter perturbation methods unsuitable for active control. The existing methods make the implicit assumption that the system responds instantaneously to the control signal, or, more precisely, that the time scale of the disturbance is longer than the response time of the system In previous applications of parameter perturbation methods there has been no significant delay in the plant. For example, in adaptive optics the effect of a change in the optical properties are measured almost instantly because the information travels at the speed of light. Another example is in the field of process control. Here the control signals change very slowly compared to the response time of the system. Parameter perturbation methods have not been applied to frequency domain control systems.

A further aspect of active control is that the time scales of the disturbance are often comparable to or less than the time delays in the physical system. This means that approaches which seek to adjust the control output directly cannot be used. Hence filtering and waveform synthesis approaches have been used in the past.

Adaptive control systems often use sensors to monitor the residual disturbance and then seek to minimize a cost function (usually the sum of squares of the differences between the desired and actual sensor signals) using gradient descent or steepest descent methods (see B. Widrow and S. D. Stearns (1985), '*Adaptive Signal Processing*', *Prentice Hall*, for example). These methods calculate the gradient of the cost function with respect to the controller coefficients. The calculation requires knowledge of each of the sensor signals and knowledge of how each of the sensors will react to each of the controller outputs. Thus these systems often require multiple inputs and complicated system identification schemes. These add cost and complexity to the control system.

The complexity can be reduced by using Frequency Domain Adaption. This technique, which was introduced in U.S. Pat. No. 4,490,841 (Chaplin et. al.), adjusts the Complex Fourier coefficients of the output signal and then uses a waveform generator to produce the output time waveform. For multi-channel systems, such as that described in U.S. Pat. No. 5,091,953 (Tretter), the frequency domain method still requires identification of the transfer function matrix since it takes explicit account of all the interactions between the actuators and the sensors. This means that the system cannot be split into separate modules.

One application of multi-channel adaptive control systems is the reduction of transformer noise. This application is well known and has been one of the applications for multi-channel frequency domain controllers. The problem is tractable because the noise is fairly constant so that slow adaption of the frequency domain output coefficients is sufficient. However, the large number of interacting channels make the control systems expensive. This is because the known adaption methods take explicit account of all of the interactions between the actuators (which may be loudspeakers, or force actuators applied to the structure or active panels) and the sensors (which may measure sound or vibration). This requires a powerful processor to perform the update calculations and to measure the interactions, and large amounts of expensive memory to store a representation of the interactions. These costs have prohibited the commercialization of active control systems for transformers.

Other applications exist where a large number of channels are required without the need for rapid adaption.

OBJECTS OF THE INVENTION

This invention relates to an adaptive control system for reducing unwanted disturbances in a system with unknown or non-linear response. The control system comprises one or more output waveform generators responsive to a timing or phase signal and output coefficient signals and producing output control signals which cause control disturbances, one or more Input processing means responsive to a combination of the control disturbances and the unwanted disturbances and producing first signals, Timing signal generation means producing said timing or phase signals, one or more adaption modules responsive to said first signals and producing output coefficient signals. The adaption module includes a perturbation generating means.

One embodiment of the control system is shown in FIG. 1.

One object of the invention is to provide an adaptive control system for controlling disturbances in a plant containing delay. The control system utilizes a new parameter perturbation method. The control system can be used for control of sound, vibration and other disturbances and for single and multi-channel systems.

Another object of the invention is to provide an adaptive control system for controlling disturbances in a non-linear plant.

Another object of the invention is to provide a new method for adjusting the coefficients in frequency domain schemes and active control schemes, such as those proposed by U.S. Pat. No. 4,490,841 (Chaplin), W. B. Conover (1956) '*Fighting Noise with Noise*', *Noise Control* 2, pp 78–82, U.S. Pat. No. 4,878,188 (Zeigler), PCT/GB90/02021 (Ross), PCT/GB87/00706 (Elliot et. al.), PCT/US92/05228 (Eatwell) for controlling periodic disturbances and by U.S. Pat. No. 4,423,289 (Swinbanks) for controlling broadband and/or periodic disturbances.

LIST OF FIGURES

SUMMARY

Figure 1:
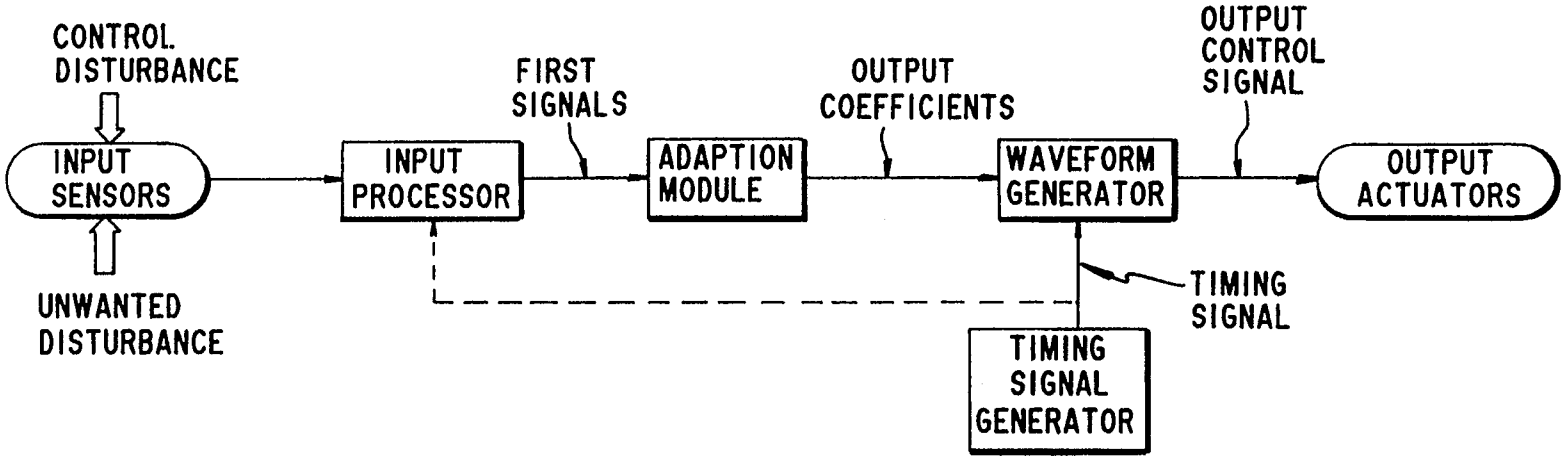
FIG. 1 is a diagrammatic view of an Adaptive Control System.

The invention avoids the need for system identification. This reduces processing requirements, and avoids the need for multiple sensor inputs to the adaption module. The control system of the invention is therefore less complex and less expensive than existing control methods.

The adaption process for each actuator is independent, the processing requirements therefore scale with the number of actuators, unlike existing systems where the processing requirements scale with the product of the number of actuators and the number of sensors. This reduces the cost of systems with many inputs and outputs.

There is no requirement to store the transfer function matrices or impulse response matrices of the system. This avoids the need for expensive electronic memory components which further reduces the cost of the control system.

The control system of the invention can be configured as a number of independent modules, one per actuator. This is in contrast to previous methods which take into account the interactions between all of the actuators and sensors. This modular configuration allows the same module to be used for different applications which results in significant cost savings.

DETAILED DESCRIPTION OF THE INVENTION

The known frequency domain adaptive control systems comprise three basic elements: An output processor for each output, which has as input a pair of output coefficients for each frequency component and a timing or phase signal and produces a corresponding time waveform; an input processor for each input, which has as input the time waveform of the error signals and a timing or phase signal and produces a set of pairs of input coefficients for each input at each frequency; and an adaption means which adjusts the output coefficients in response to the input coefficients.

According to one aspect of the invention, the one or more inputs to the input processor may be replaced by the single input (which may have two components) produced by a function generator or by the multiple inputs (one per frequency) from a number of such function generators. The function generator may generate a signal related to the change in residual disturbance across all of the sensors and across all frequencies, or to the change in the residual across all sensors in a particular frequency band. In the latter case the frequency band may be determined by the frequency content of the disturbance to be controlled.

By way of example we shall describe the case where the controller performance is quantified by a cost function which is the mean square error across all sensors. This same cost function is used by the known methods.

The description will be in the frequency domain. The background art contains several methods for obtaining frequency domain information from time domain information. These include Discrete Fourier Transforms (DFTs) as described by U.S. Pat. No. 4,490,841 (Chaplin et. al.), Harmonic Filters as in PCT/US92/05228 (Eatwell) and heterodyning and averaging as in PCT/GB90/02021 (Ross). These methods may be incorporated into the input processor in some embodiments of the current invention. In other embodiments, the input processor does not produce separate frequency components.

The output processor of the current invention converts the output coefficients into an output time waveform. There are several known techniques for achieving this. These include using the output coefficients to produce a weighted sum of sinusoidal waveforms (as in PCT/GB87/00706 (Elliot et. al.) and in PCT/GB90/2021 (Ross)) and using a Discrete Fourier Transform (as in U.S. Pat. No. 4,490,841 to Chaplin) to produce a stored waveform which is synchronized to a frequency signal.

The input and output processors described above use a timing signal to synchronize them to the frequencies of the noise source. This can be a frequency signal, such as from a tachometer attached to the source or from a disturbance sensor, or a phase signal, such as from a shaft encoder on a machine or the electrical input to a transformer or electric motor or from a disturbance sensor. Alternatively the timing signal can be provided by a clock to provide a fixed phase or frequency signal.

We start by describing how changes to the output coefficients affect the residual signals.

At each frequency, $\omega$, the vector of residual components is the superposition of the vector of original noise, $y(t,\omega)$, and the response to the vector of components of the control signals, $x(t,\omega)$. The control signals are modified by the complex system step-response, $B(t,\omega)$ (which is a matrix for multi-channel systems). In the steady state condition x, y and B are functions of the frequency only. In an adaptive system the output is constantly changing, so x, y and B are functions of time as well as frequency. The physical system will normally have some delay and reverberation associated with it, so when the output signal is being varied at each iteration, the residual signal will depend upon past output signals as well as the current noise $y(\omega)$. Thus, at each frequency, the vector of residual components at the j-th measurement (time $t_j$) is given by $$e_j = \sum_{i=1}^{\infty} B_i \delta x_{j-i} + y_j, \tag{1}$$

where $\delta x_j$ is the sequence of changes in the output coefficients and the frequency dependence is implicit. When there is delay in the system some of the coefficients, including $B_1$, may be zero. In some control applications the desired response may be non-zero, in which case the vectors of desired responses is subtracted from the fight hand side of equation (1).

Figure 2:
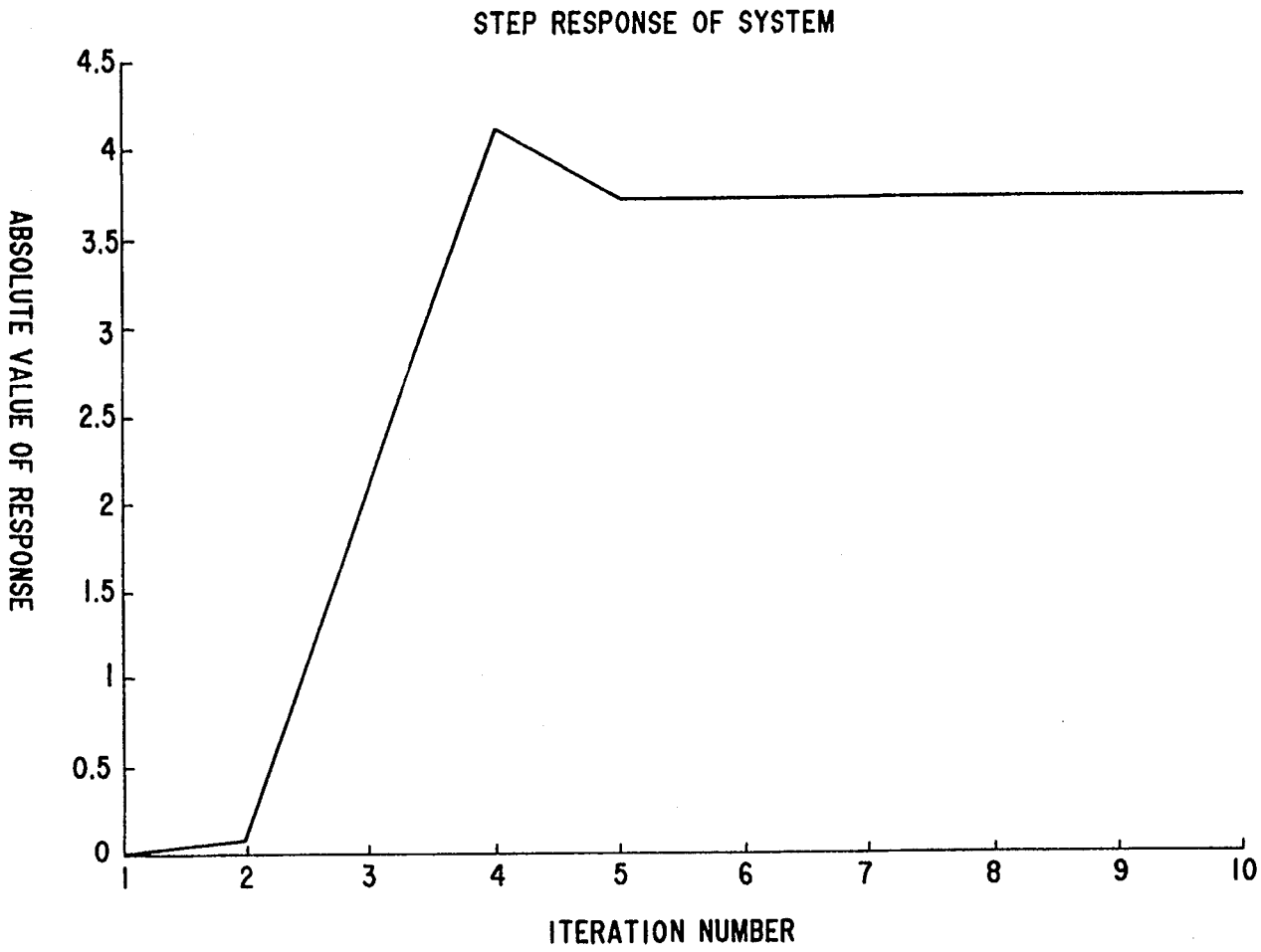
FIG. 2 is a diagrammatic view of a Frequency domain step response of a typical system.

An example of the step-response of a single channel system is shown in FIG. 2. This shows the absolute value of the complex step-response as a function of iteration number (time). Each iteration corresponds to one cycle of the disturbance. Thus for this system it takes five cycles to reach the steady state condition. For this system the delay is much longer than the time scale of the disturbance.

PERTURBATION GENERATOR

In the parameter perturbation method of this invention the changes in the output coefficients have two components: an update term, $-\mu G$, designed to reduce the cost function, and a perturbation term, d. That is $$\delta x_j = -\mu G_j + d_j. \tag{2}$$

Both G and d are vectors with one component for each output channel. The perturbation signals can take many forms. Preferably the perturbations for each channel are independent with respect to some inner product or correlation measure. They can for example be a sequence of random or pseudo random complex numbers with prescribed or adjustable statistics. They can be orthogonal sequences (as in U.S. Pat. No. 3,617,717 (Smith)). The components of the vector G will be referred to as the gradient signals. The next section is concerned with methods for determining these signals.

GRADIENT SIGNAL GENERATOR

A settling time can be defined for a given physical system, this is time taken for the inputs to settle to within a prescribed amount of the steady state level following a change in the output coefficients. The settling time is taken to be T measurement periods, where T is such that the following condition holds $$\| B_i - B_\infty \| < \epsilon, \text{ for } i > T, \tag{3}$$

where $\| \cdot \|$ denotes the norm of the matrix.

The vector of error signals can be written as $$\begin{aligned} e_j &= \sum_{i=T}^{\infty} B_i \delta x_{j-i} + \sum_{i=0}^{T-1} B_i \delta x_{j-i} + y_j \\ &= A \sum_{i=T}^{\infty} \delta x_{j-i} + \sum_{i=0}^{T-1} B_i \delta x_{j-i} + y_j \\ &= A \cdot x_{j-T} + \sum_{i=0}^{T-1} B_i \delta x_{j-i} + y_j \end{aligned} \tag{4}$$

where $A(\omega) = B_\infty$, $(\omega)$ is the system transfer function matrix, that is the steady state value of B. Hence, the error is a combination of a steady state response, a transient response and the original disturbance.

The cost function E, that is the measure of the success of the control system, may be taken to be the sum of the magnitude squared of the residual components at a particular frequency $$E(\omega) = e(\omega)^* e(\omega), \tag{5}$$

or as the sum over all frequencies. The superposed asterisk denotes the conjugate transpose of the vector. The cost function is related to the power in the error signal at the particular frequency or across all frequencies, and could be calculated directly from the time series or by passing the time series through one or more bandpass filters, or by calculating the Fourier coefficients of the time series.

The well known gradient descent algorithms make changes to the output coefficients proportional to the gradient of the cost function with respect to the output coefficients.

For example, the known LMS update algorithm in the frequency domain (described in U.S. Pat. No. 5,091,953 (Tretter), for example) uses the product of the conjugate transpose of A with the current error signal $$x_{j+1} = x_j - \mu G = x_j - \mu A^* e_j. \tag{6}$$

The adaption of any of the output coefficients requires knowledge of all of the inputs, $e_j$, and the transfer function matrix, A.

In the method of this invention, additional changes or perturbations are made to the output coefficients as in equation (2).

We now consider the change in the error signal over the settling time, T periods. The change is $$\begin{aligned} e_j - e_{j-T} &= A \sum_{i=T}^{\infty} \delta x_{j-i} + \sum_{i=1}^{T-1} B_i \delta x_{j-1} + y_j - \\ &\quad A \sum_{i=2T}^{\infty} \delta x_{j-i} + \sum_{i=1}^{T-1} B_i \delta x_{j-T-i} + y_{j-T} \\ &= A \sum_{i=T}^{2T-1} \delta x_{j-i} + \sum_{i=1}^{T-1} B_i (\delta x_{j-1} - \delta x_{j-T-i}) \\ &= A(x_{j-T} - x_{j-2T}) + \sum_{i=1}^{T-1} B_i (\delta x_{j-i} - \delta x_{j-T-i}) \end{aligned} \tag{7}$$

The important aspects of the last two equations are that first terms on the right hand side are related to the steady state (lasting) change in the error, and that the term $\delta x_{j-T}$ only occurs in these first terms. This suggests several ways in which the transfer function, A, could be estimated. These include correlating the change in the error with the past change in the output coefficients or with the total change in the previous settling period, or with the past perturbation, or with the sum of the perturbations over the past settling period.

For example, one estimate is $$A=[(e_j-e_{j-T})\delta x^*_{j-T}][\delta x_{j-T}\delta x^*_{j-T}]^{-1}, \quad (8)$$

where the superposed asterisk denotes the conjugate transpose. A similar approach, which does not make any allowance for the settling time, is described in U.S. Pat. No. 5,091,953 (Tretter). This can alternatively be estimated by a Least Mean Square algorithm such as $$A_{j+1}=A_j-\gamma(A_j\delta x_{j-T}-(e_j-e_{j-T}))\delta x^*_{j-T}, \quad (9)$$

where $\gamma$ is a positive constant, or by a known recursive Least Squares algorithm.

It is a further aspect of this invention that rather than estimate the transfer function matrix, A, and then calculate the gradient vector G, the gradient vector itself is estimated directly. The conjugate transpose of equation (9) can be post-multiplied by the vector of residuals to give $$G_{j+1}=G_j-\gamma\delta x_{j-T}\delta x^*_{j-T}G_j+\gamma\delta x_{j-T}(e_j-e_{j-T})^*e_j, \quad (10)$$

where $$G=A^*e. \quad (11)$$

It is important to note that G is a vector quantity with one component per actuator, rather than a matrix quantity. Recursive algorithms can also be used to estimate G, these include the SER algorithm described in B. Widrow and S. D. Stearns (1985), '*Adaptive Signal Processing*', *Prentice Hall*, use the auto-correlation matrix of the perturbations. This style of algorithm is especially beneficial when the changes to the outputs are not independent.

Provided that the perturbations are independent of one another and are larger than the other changes in the output coefficients, equation (10) can be approximated by $$G_{j+1}=(1-\alpha)G_j+\alpha.\sigma^{-2}\delta x_{j-T}\delta e^*_j e_j, \quad (12)$$

where $\sigma$ is an estimate of the RMS level of the change to the outputs and $\delta e_j=e_j-e_{j-T}$ is the change in the error over the settling period. $\alpha$ is a positive constant. This is an LMS algorithm for the gradient signal. Other algorithms can be similarly derived. Equation (12) is a sampled data version of the associated analog form $$G(t)=\frac{\alpha}{T_{samp}}\int^t(-G(t')+\sigma^{-2}\delta x(t'-T)\delta e_j^*e_j(t'))dt' \quad (13)$$

where $T_{samp}$ is the sampling rate.

Equations (12) and (13) describe two forms of the gradient signal generator.

INPUT PROCESSOR

The gradient signal generator described in equations (12) and (13) is responsive to the signal $\delta e^*_j e_j$. This signal is a vector product and so represents a signal complex number for each frequency. The individual component of the vector equation (12) (one for each output channel) are all responsive to this same signal Hence the control system need only have one input processor (per frequency) and this input processor is completely independent of the number of actuators. Further, the output from the input processor is merely the sum of outputs from processors for each input channel. This means that, apart from this summation, the input processor can be constructed from smaller modules, each responsive to one or more input channels.

Figure 5:
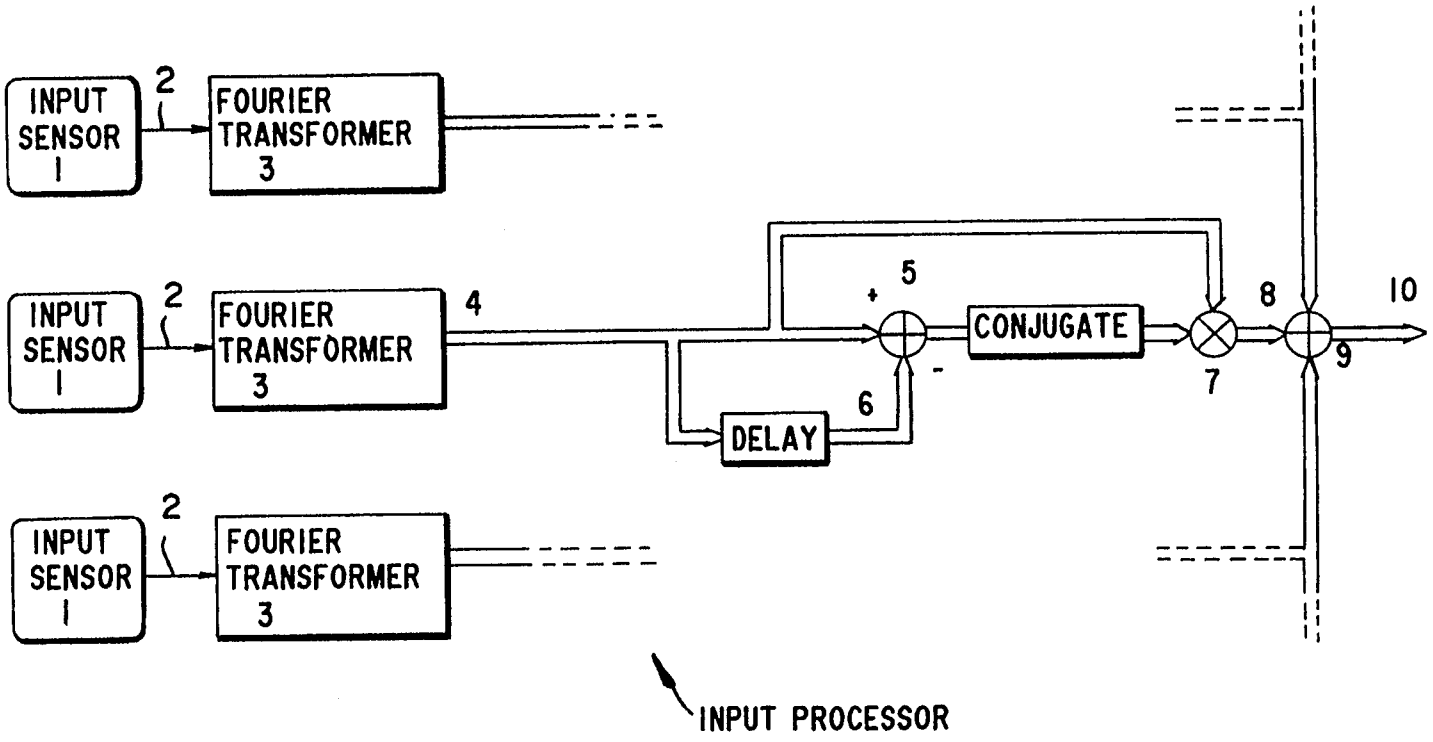
FIG. 5 is a diagrammatic view of an Input Processor.

One embodiment of this type of input processor is shown in FIG. 5. Each input sensor, 1, produces an input signal, 2, which is fed to a Fourier Transformer or signal demodulator, 3. This device produces the complex coefficients, 4, of the input signals at one or more frequencies. The frequencies may be set relative to a frequency signal. This may in turn be derived from a timing or phase signal. Many types of Fourier Transformers or signal demodulators are known. The change in the coefficients over a specified time period is then determined at 5 by calculating the difference between the current coefficient and the delayed coefficients, 6, The complex conjugate of this difference is then multiplied at 7 by the current coefficients, 4, to produce the output, 8, from one sensor channel. This is combined with the outputs from other sensor channels in combiner, 9, to produce the output, 10, from the input processor.

ADAPTION MODULE

The adaption module comprises a gradient signal generator, a perturbation generator and an update processor. The operation of the update processor is described by the update equation. One form of the update equation uses the gradient signal given by equation (12) together with $$x_{j+1}=(1-\lambda\mu)x_j-\mu G_j+d_j, \quad (14)$$

where $\lambda$, is factor which can be adjusted to limit the level of the output if desired. This equation can also be considered as a sampled data implementation of an integrator. An associated analog form of the update equation is $$x(t)=\frac{1}{T_{samp}}\int^t(d(t')-\lambda\mu x(t')-\mu G(t'))dt'. \quad (15)$$

A controller which implements the equations (12) and (14) or (13) and (15) is one aspect of this invention.

From equations (12) and (14) it can be seen that the update of each output coefficient is independent of the others. Further the common input to each adaption process is the single complex number $\delta e^*_j e_j$. The control system can therefore be configured as a single input processor which generates the quantity $\delta e^*_j e_j$ and supplies it to a number of independent adaption modules, one for each actuator. This results in a far simpler control system than previous methods.

One important feature of the adaption module is that the adaption module for each output channel is independent of the other channels. This means for example that a modular control system can be built and additional output channels can be added without affecting the processing of existing channels. Previous methods take into account all of the interactions between the channels, so modular systems cannot be built.

One application of active noise control is for a Silent Seat as described in U.S. Pat. No. 4,977,600 (Zeigler). When a number of seats are used together it was previously necessary to use a multi channel control system. When the present invention is used an adaption module can be supplied for each seat, and these modules do not depend on the number of seats or the interactions between them.

ALTERNATIVE FORM OF THE INPUT PROCESSOR

The method described above makes the assumption that the physical system is linear. This may not always be the case, although it is usually a good approximation. We can however extend the method to non-linear systems. This results in a simplification in the single input processor. This simplification can of course be applied to linear systems, but is not as accurate as the method described above.

The more general method makes use of the change in the cost function over the settling period. It is easy to show that, for a single change in the output coefficients, the change in the cost function is $$E(x_j)-E(x_{j-T})=\delta x^*_{j-T}\nabla E+\nabla E^*\delta x_{j-T}+\text{higher order terms,} \quad (16)$$

where, the higher order terms are at least quadratic in the perturbations. This equation can be correlated with $\delta x_{j-T}$ to give an estimate of the gradient $G=\nabla E$, the adaptive estimate, (analogous to equation (12)), is $$G_{j+1}=(1-\alpha)G_j+\alpha.\sigma^{-2}\delta x_{j-T}\delta E_j. \quad (17)$$

where $\delta E_j=E_j-E_{j-T}$ is the output from the alternative input processor. This alternative input processor thus calculates the change in the cost function over a prescribed time period. This period is chosen with regard to the settling time of the physical system.

Figure 6:
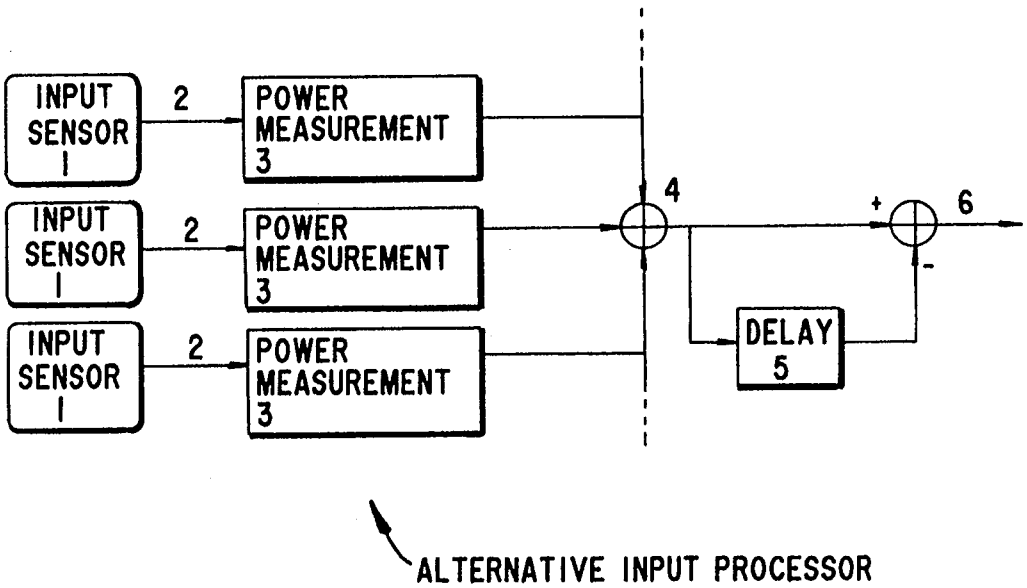
FIG. 6 is a diagrammatic view of an Alternative Input Processor.

One embodiment of an input processor of this form is shown in FIG. 6. Each input sensor, 1, produces an input signal, 2. The power in each of these input signals is determined by power measuring means, 3, and then the powers are combined in combiner, 4, to produce a total power signal. This combiner may produce a weighted sum of the signals where the weights can be determined by the positions or the sensors, the type of sensor and/or the sensitivity of the sensor. The total power signal is passed to delay means, 5. The difference between the current total and the output from the delay means provides the common input signal, 6, for the adaption modules.

Equation (17) can be used together with equation (14) to adjust the output coefficients.

For a linear system the cost function is quadratic in the perturbations. Equation (12) is more accurate since it includes all of the higher order terms, but equation (17) is simpler to calculate. Further, since the perturbations at this current frequency are independent of those at other frequencies, the gradient can be calculated from the change in the total power, rather than the change in the power at the frequency of interest. The total power can be estimated directly from the time domain signal using known techniques, either digitally or using an analog circuit, without the need for Fourier Transforms or bandpass filters. This makes the input signal processor much simpler and less expensive.

DESCRIPTION OF ONE EMBODIMENT

Figure 3:
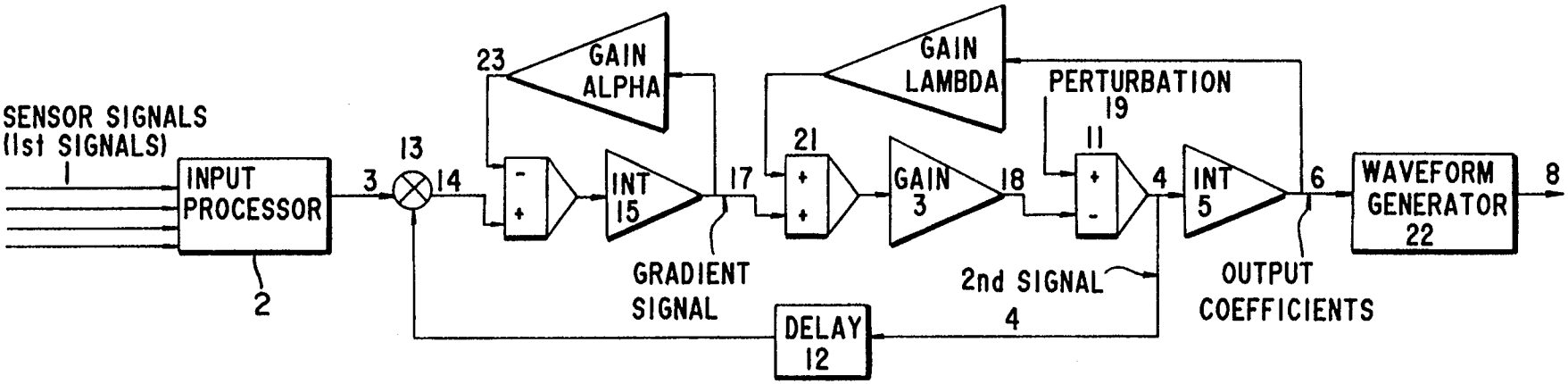
FIG. 3 is a diagrammatic view of a Single Adaption Module.

One embodiment of an adaption module corresponding to equations (12) and (14), or the equivalent equations (13) and (15), is shown in FIG. 3.

The first signals, 1, from the residual sensors are combined in the input processor, 2, to produce a signal, 3, corresponding to the complex signal $\delta e^*_j e_j$ or the real signal $\delta E_j=E_j-E_{j-T}$. This signal is common to the blocks for all of the output components, so this portion of the control system is not duplicated for other blocks. The output is produced by waveform generator or modulator, 22, which is responsive to the output coefficient, 6. The resulting signal, 8, is combined with the signals from other adaption modules (component blocks) to produce the control signal for one actuator. The output coefficient signal, 6, is produced by passing a second signal, 4, which is a combination of a weighted gradient signal, 17, and a perturbation signal 19, through integrator, 5. Optionally, the coefficient signal, 6, is 'leaked' back to the input of the integrator through gain lambda and combiner 21. The amount of leak is determined by the gain lambda, which can be adjusted to limit the level of the output. The adaption rate is determined by the gain, 3.

The input, 4, to the integrator, 5, is delayed in a delay means, 12, and then multiplied, in multiplier 13, by the output, 3, from the input processor to produce signal 14. The gradient signal, 17, is passed through gain alpha to produce signal 23. The difference between the signal 14 and the signal, 23, is integrated in integrator 15 to produce the new estimate of the gradient signal, 17.

The control system may be implemented as a sampled data system, such as a digital system, or as an analog system. The digital system is defined by equations (12) and (14) above.

DESCRIPTION OF A MULTI CHANNEL EMBODIMENT

Figure 4:
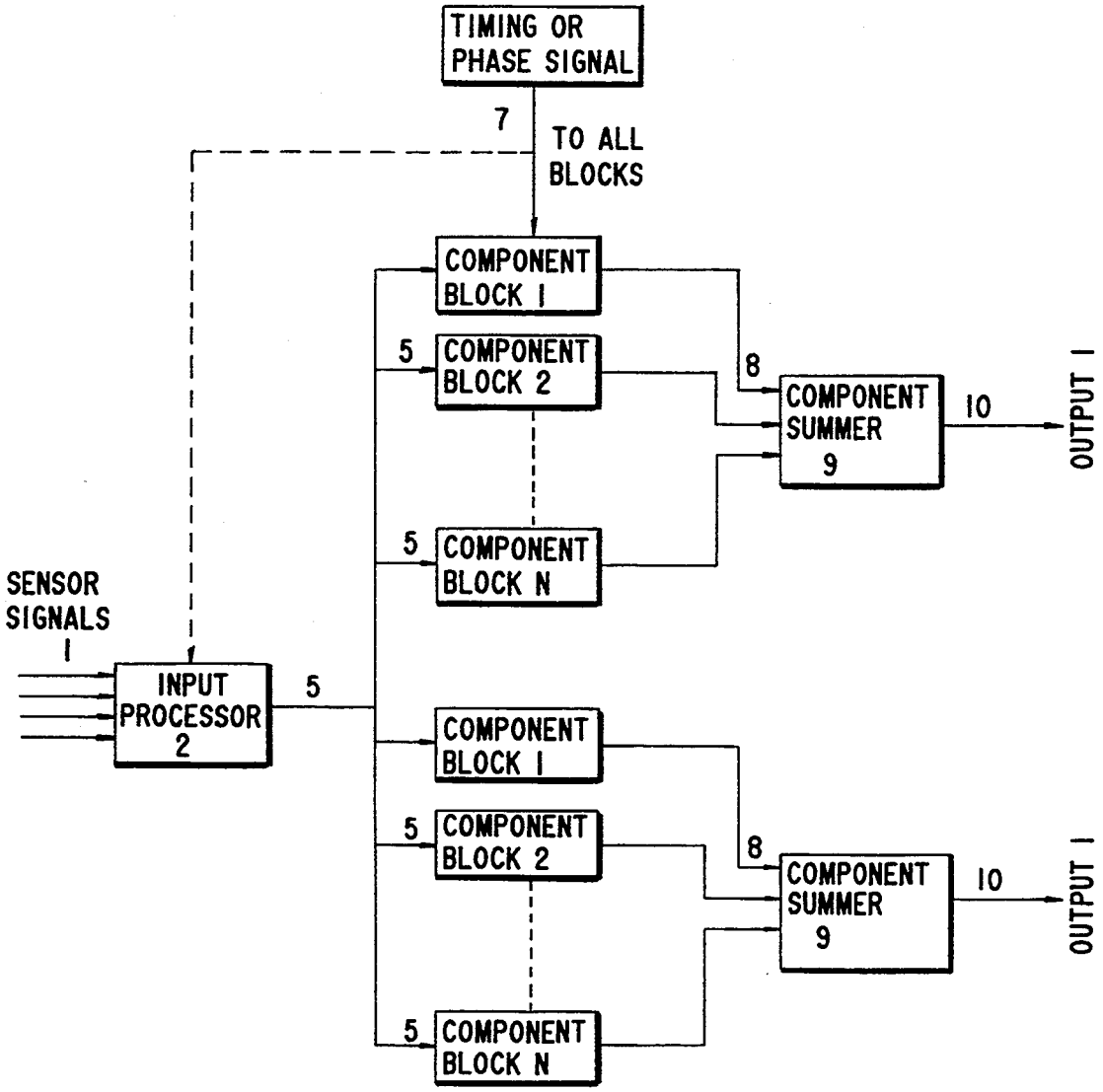
FIG. 4 is a diagrammatic view of Multiple Adaption Modules.

One embodiment of a complete system is shown in FIG. 4. Input signals, 1, from one or more sensors are applied to an input processor, 2, which may be digital or analog. The sensors are responsive to the residual disturbance. The resulting signal, 5, is applied to each of the component blocks or adaption modules. For each output signal there are N component blocks, two for each frequency (corresponding to the in-phase and quadrature components at that frequency). Each output is obtained by summing the outputs from the N component blocks in component summer, 9. Each component block could be implemented as a separate module, or the component blocks could be combined with the component summer to produce an adaption module for each output, or a number of output channels could be combined to produce a larger module. The frequency or phase of the modulation signal, 7, is set by a timing signal or phase signal. This signal is used to generate the sinusoidal modulation signals. These modulation signals may be generated in each component block so as to obtain a modular control system, or the signals for each frequency may be generated in a common signal generator shared by the component blocks, since the same signal is used by each of the outputs. In one embodiment, the input processor generates one signal per frequency. This signal is then supplied to the appropriate component block for each output. In this case, the frequency or phase signal, 7, may optionally be used by the input processor.

In another embodiment, the inverse Discrete Fourier Transform of the output coefficients is calculated to provide the time waveform for one complete cycle of the noise, this waveform is then sent synchronously with the phase of time signal.

In some applications the frequency may be fixed, in which case the timing or phase signal may be set by a clock. In other applications the frequency may be varying or unknown, in which case the frequency or phase signal can be obtained from measuring the frequency or phase of the source of the disturbance, such as with a tachometer, or by measuring the frequency or phase of the disturbance itself.

CHOICE OF PARAMETERS

The choice of the parameter $\mu$ in the adaption equation (14) depends upon the characteristics of the system. However, it is possible to normalize this parameter so as to make the choice easier. One way of performing the normalization will now be described.

In a digital implementation, the cost function for a new output, x' can approximated by a Taylor expansion $$E(x')=E(x)+\nabla E^{*}\delta x(x)+\delta x^{*}\nabla E(x). \tag{18}$$

For one step convergence of the adaption process we require that $E(x')=0$. This suggests that the change to the output coefficients should be $$\delta x=(\nabla E.\nabla E^{*})^{-1}\nabla E.E(x) \tag{19}$$

The matrix can be calculated recursively from the estimate of the gradient, although care should be taken to avoid the matrix becoming singular. Alternatively, a simpler approach can be adopted which is to use a normalized step size given by $$\mu_{norm}=\mu.E|(\|\nabla E\|+\epsilon) \tag{20}$$

where $\|.\|$ denotes the norm of the gradient (which can be calculated from the sum of squares of the elements for example) and $\epsilon$ is a small positive number to prevent division by zero.

The level of the perturbation can be adjusted according to the level of the cost function. One such scheme for use when a quadratic cost function is used is to take the perturbation level to be proportional to the square root of the cost function.

TIME ADVANCED INPUTS

In some applications the source of the disturbance is some distance from the control system. If the frequency or phase of the source is used to set the frequency or phase of the modulation signals, then it may be necessary to delay the frequency or phase signal in order to compensate for the time taken for the disturbance to propagate from the source to the control region. A similar issue is discussed in U.S. Pat. No. 3,617,717 (Smith). This problem is associated with the reference inputs being received too early, and is unconnected with the delay associated with the settling time of the system. However, the solution proposed in U.S. Pat. No. 3,617,717 puts the delay at the output to the controller which will increase the settling time of the system and so slow down or prevent adaption of the system. The solution proposed here is to put the delay in one of the inputs to the control system (the frequency or phase input), this does not increase the settling time of the system.

REDUCTION TO PRACTICE

A digital version of the above control system has been implemented. The controller was not operated in real time and the physical system was modeled by a linear (Finite Impulse Response) filter. The controller implemented equations (12), (14) and (20). The disturbance was taken to be a single sinusoidal signal. The Fourier components where obtained by synchronous sampling of the computed residual signals followed by a Discrete Fourier Transform, as described in U.S. Pat. No. 4,490,841 (Chaplin et. al.) for example.

For the test case the optimal output coefficient has a real part of 1 unit and an imaginary part of 1 unit.

Figure 7:
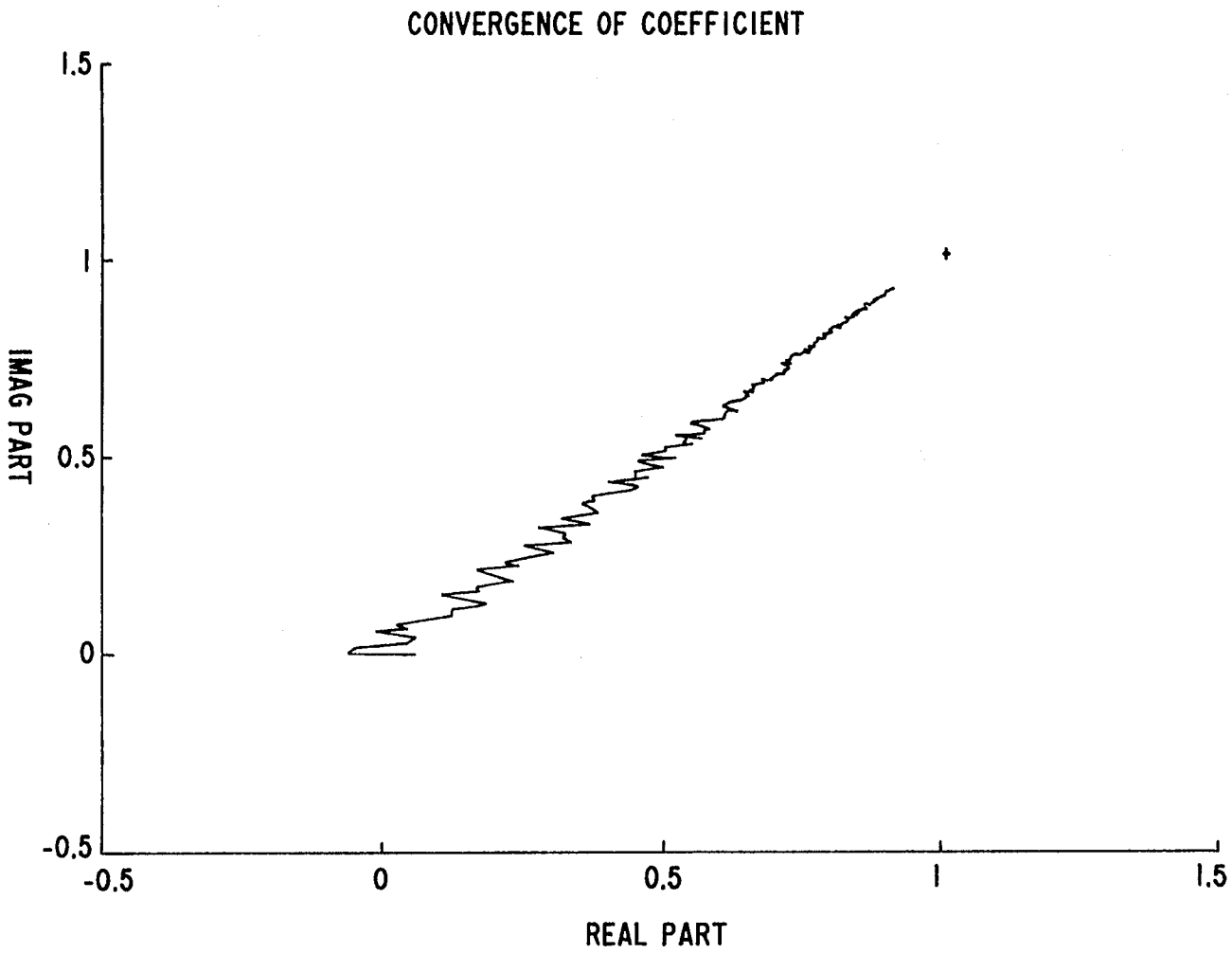
FIG. 7 is a diagrammatic view of the convergence of complex output coefficient.

The convergence of the output coefficients from their initial zero values towards the optimal values is shown in FIG. 7. The level of perturbation is scaled on the level of the residual signal, that is, on the square root of the cost function. This can be seen in the Figure, since the variations in the coefficients, which is due to the perturbations, decreases as the coefficients approach their optimal values.

Figure 8:
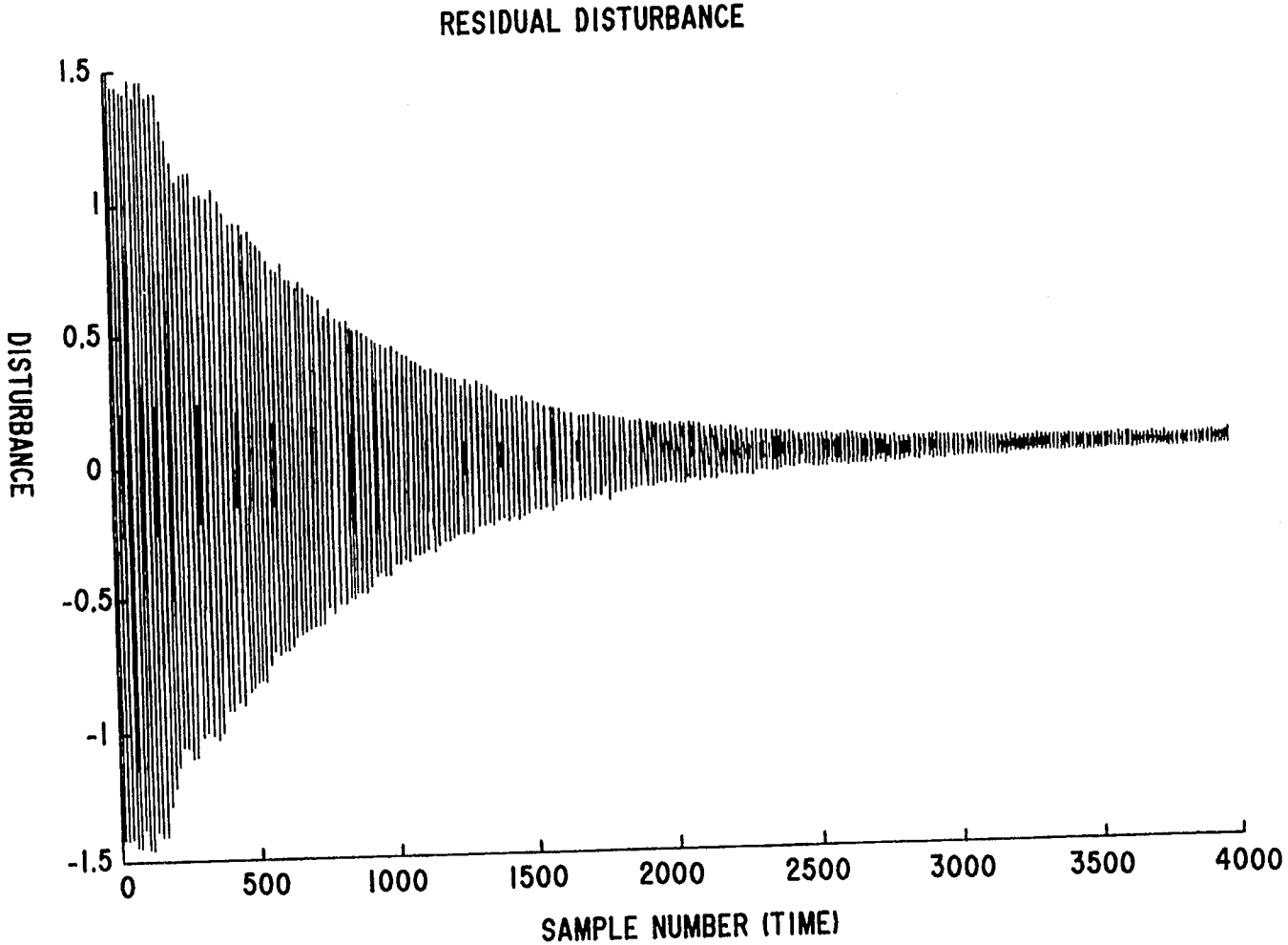
FIG. 8 is a diagrammatic view of a Residual Disturbance.

The value of the cost function, in decibels relative to a unity signal is shown in FIG. 8. Each iteration corresponds to one cycle of the noise. For example, for a fundamental frequency of 120 Hz, there are 120 iterations in 1 second. The step size, which corresponds to $\mu_{norm}$, is 0.05, the smoothing parameter, $\alpha$, in the gradient estimation is 0.02 and the perturbation level is 0.05 of the residual level.

Figure 9:
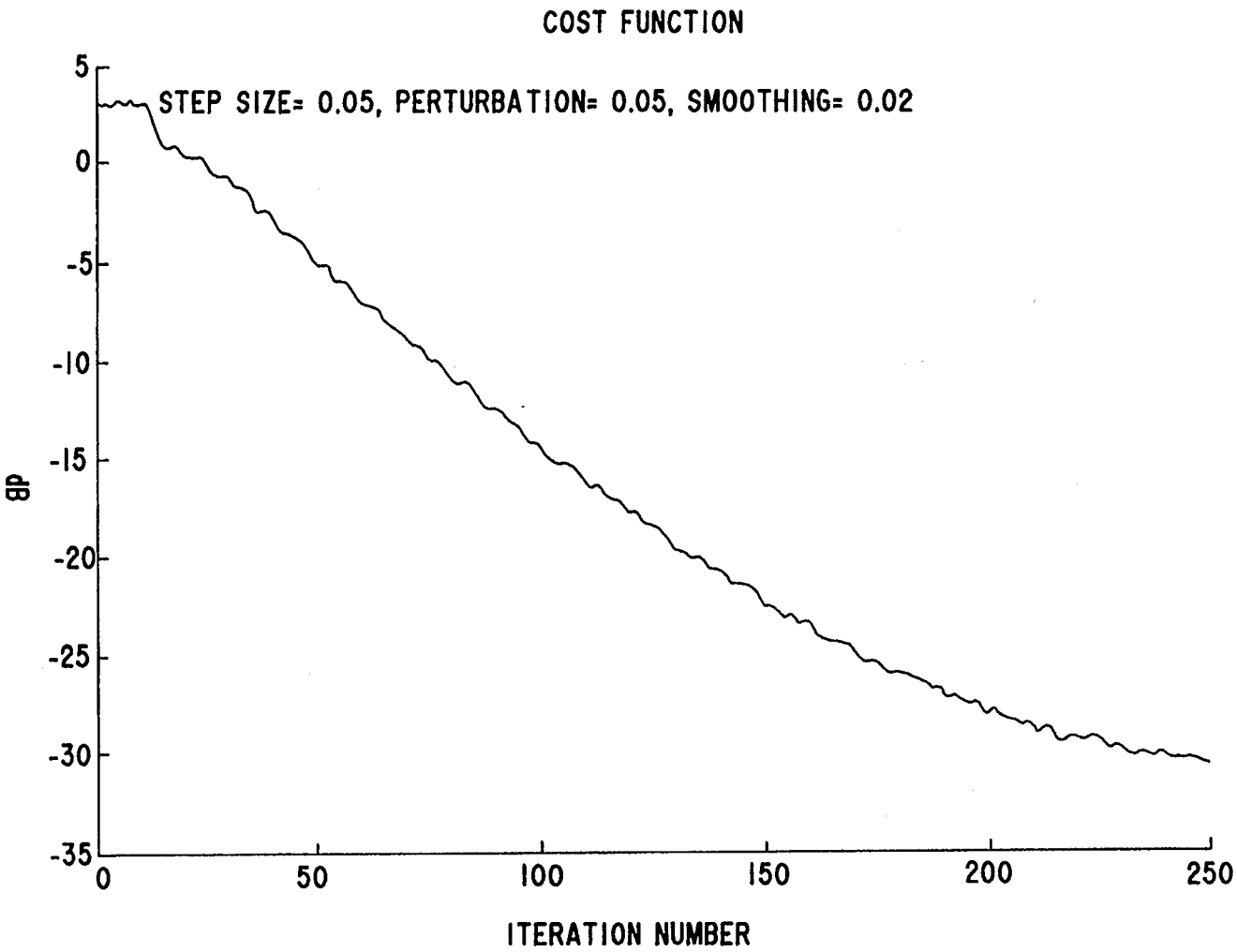
FIG. 9 is a diagrammatic view of a Cost Function.

The corresponding disturbance signal is shown in FIG. 9. There are 16 samples in each cycle of the disturbance.

I claim:

1. An adaptive control system for reducing unwanted disturbances in a system with unknown or non-linear response, said control system comprising output waveform generator responsive to a timing or phase signal and output coefficient signals and adapted to produce output control signals configured to cause control disturbances, input sensing means adapted to respond to a combination of said control disturbances and said unwanted disturbances to thereby produce input signals, input processing means adapted to respond to said input signals to thereby produce first signals, timing signal generation means adapted to produce said timing or phase signals, gradient signal generating means adapted to respond to said first signals to produce a gradient signal, first integration means which has as input a second signal and produces an output coefficient signal, said second signal being a weighted combination of said perturbation signal, a gradient signal and said output coefficient signal and produces an output coefficient signal, perturbation generating means adapted to produce perturbation signals which perturb said output coefficient signals to thereby modify said control disturbances, said system characterized in that said gradient signal generator comprises delay means responsive to said second signal and producing a delayed signal, multiplier means for multiplying said first signals with said delayed signal, and second integration means which has as input a weighted combination of the output from said multiplying means and said gradient signal and produces as output said gradient signal.

2. A system as in claim 1 in which said input processing means comprises an analog circuit.

3. A system as in claim 1 in which said output waveform generator means comprises an analog circuit.

4. A system as in claim 1 in which said adaption module means comprises an analog circuit.

5. A system as in claim 1 in which said adaption module means comprises a digital processing system.

6. A system as in claim 1 in which said perturbation signals are mutually orthogonal or independent over some fixed time period.

7. A system as in claim 1 in which the level of said perturbation signals is scaled on the level of a cost function or the input signals.

8. A system as in claim 1 in which said adaption module is a digital processor which operates according to the equations $$G_{j+1}=(1-\alpha)G_j+\beta\delta x_{j-T}I_j$$

$$x_{j+1}=(1-\lambda\mu)x_j-\mu G_j+d_j$$

where $\alpha$, $\beta$, $\mu$ and $\lambda$ are parameters, I is the output from the input processor, G is the gradient signal, d is the perturbation signal, x is the output coefficient $\delta x$ is a previous change to the output coefficient and T is the number of samples of delay associated with said delay means.

9. A system as in claim 1 in which said adaption module is an analog circuit which operates according to the equations $$G(t) = \alpha \int^{t} (-G(t') + \beta\delta x(t' - T)I(t'))dt'$$

$$x(t) = \gamma \int^{t} (d(t') - \lambda\mu x(t') - \mu G(t'))dt'$$

where $\alpha$, $\beta$, $\gamma$, $\mu$ and $\lambda$ are parameters, I is the output from the input processor, G is the gradient signal, d is the perturbation signal, x is the output coefficient, $\delta x$ is a previous change to the output coefficient and T is the delay associated with said delay means.

10. A system as in claim 1 in which the said perturbation signals are mutually orthogonal or independent.

11. A system as in claim 1 in which the input processor operates to provide a complex output signal, I which is calculated according to the equation $$I_j=\delta e^{*}je_j$$

where e is the vector of coefficients of the input signals at a particular frequency, $\delta e$ is change in the vector of coefficients of the input signals over a specified time period and the star denotes the conjugate transpose of the vector.

12. A system as in claim 11 in which the timing signal is generated in response to a frequency and/or phase measuring means.

13. A system as in claim 1 in which uses the auto-correlation matrix of the changes in the output coefficients.

14. A system as in claim 13 in which the auto-correlation matrix of the changes in the output coefficients is approximated recursively.

15. An adaptive control system for reducing unwanted disturbances in a physical system with unknown or non-linear response, said control system comprising output waveform generator responsive to a timing or phase signal and output coefficient signals and adapted to produce output control signals configured to cause control disturbances, input sensing means adapted to respond to a combination of said control disturbances and said unwanted disturbances to thereby produce input signals, input processing means adapted to respond to said input signals to thereby produce first signals, timing signal generation means adapted to produce said timing or phase signals, adaption module means adapted to respond to said first signals to produce output coefficient signals, perturbation generating means adapted to produce perturbation signals which perturb said output coefficient signals to thereby modify said control disturbances, said system characterized in that said input processor comprises cost function generator responsive to said input signals and adapted to produce a third signal, delay means adapted to delay said third signal by a time related to the delay in said physical system, subtraction means responsive to said delayed third signal and said third signal and adapted to produce said first signal.

16. A system as in claim 15 in which the delay is determined by the combined response time of the physical system and the control system.

17. A system as in claim 15 in which the delay is determined from the cross-correlation between the changes in the output coefficients and changes in the cost function.

18. An adaptive control system for reducing unwanted disturbances in a system with unknown or non-linear response, said control system comprising output waveform generator responsive to a timing or phase signal and output coefficient signals and adapted to produce output control signals configured to cause control disturbances, input sensing means adapted to respond to a combination of said control disturbances and said unwanted disturbances to thereby produce input signals, input processing means adapted to respond to said input signals to thereby produce first signals, timing signal generation means adapted to produce said timing or phase signals, adaption module means adapted to respond to said first signals to produce output coefficient signals, perturbation generating means adapted to produce perturbation signals which perturb said output coefficient signals to thereby modify said control disturbances, said system characterized in that the level of said perturbation signals is scaled according to the level of the input signals or the level of a cost function dependent upon said input signals.

19. A system as in claim 18 and including an electrical power transformer combined with actuators, sensors and configured so as to reduce noise radiated from the transformer.

20. A system as in claim 18 which includes a number of independent adaption module means, each of which controls one or more frequency coefficients.

21. A system as in claim 20 in which each adaption module means is packaged together with an actuator and or power amplifier means.

22. A system as in claim 20 in which each adaption module means is implemented as a single integrated circuit.

23. A system as in claim 18 and including a seat or headrest combined with actuators, sensors and adapted to reduce the sound in a specified region.

24. A system as in claim 23 and including a noise reducing system for vehicle or aircraft or marine cabins including one or more systems, characterized in that one adaption module is used with each seat or headrest.

* * * * *